US011673066B1

(12) United States Patent
D'Avanzo et al.

(10) Patent No.: US 11,673,066 B1
(45) Date of Patent: Jun. 13, 2023

(54) THEMED INTERACTIVE ENVIRONMENT IN THE FORM OF A MOTEL OR HOTEL AND METHOD OF OPERATING THE SAME

(71) Applicants: Scott D'Avanzo, Ladera Ranch, CA (US); Ashton D'Avanzo, Ladera Ranch, CA (US)

(72) Inventors: Scott D'Avanzo, Ladera Ranch, CA (US); Ashton D'Avanzo, Ladera Ranch, CA (US)

(73) Assignee: Adrenalin Technologies, LLC, Ladera Ranch, CA (US)

( * ) Notice: Subject to any disclaimer, the term of this patent is extended or adjusted under 35 U.S.C. 154(b) by 0 days.

(21) Appl. No.: 16/827,149

(22) Filed: Mar. 23, 2020

Related U.S. Application Data

(63) Continuation of application No. 15/716,443, filed on Sep. 26, 2017, now Pat. No. 10,596,474.

(60) Provisional application No. 62/399,824, filed on Sep. 26, 2016.

(51) Int. Cl.

| | |
|---|---|
| ***A63J 11/00*** | (2006.01) |
| ***A63G 31/00*** | (2006.01) |
| ***A63G 31/10*** | (2006.01) |
| ***A63J 5/04*** | (2006.01) |
| ***A63G 21/02*** | (2006.01) |
| ***A63J 1/02*** | (2006.01) |
| ***E04H 3/02*** | (2006.01) |

(52) U.S. Cl.
CPC ..... *A63G 31/00* (2013.01); *A63G 21/02* (2013.01); *A63G 31/10* (2013.01); *A63J 1/02* (2013.01); *A63J 5/04* (2013.01); *A63J 11/00* (2013.01); *E04H 3/02* (2013.01)

(58) Field of Classification Search
CPC ..... A63G 31/00; A63J 11/00
USPC ..... 472/62, 74, 136
See application file for complete search history.

(56) References Cited

U.S. PATENT DOCUMENTS

| | | | | |
|---|---|---|---|---|
| 5,393,074 A * | 2/1995 | Bear | A63F 9/0291 273/440 |
| 8,574,085 B1 * | 11/2013 | Jackson | A63J 11/00 472/62 |
| 2010/0056285 A1 * | 3/2010 | Weston | A63G 31/00 472/136 |
| 2015/0084741 A1 * | 3/2015 | Bergdale | G07C 9/29 340/5.61 |

* cited by examiner

*Primary Examiner* — Kien T Nguyen
(74) *Attorney, Agent, or Firm* — FisherBroyles, LLP; Rob L. Philips

(57) ABSTRACT

A hotel or motel room incorporates special effects in accordance with a particular theme (e.g., haunted room). A control room provides a concealed area for personnel and/or automated systems to trigger the special effects which may include, but are limited to shaking, rattling, rumbling, pepper ghosts, water fixtures being activated, thunder and lightning, swapping tiles with digital graphics, turning on a TV, clock or light, etc. Heat sensors, weight sensors, floor mats and/or other sensors determine positions of guests in the hotel and hotel rooms thereby allowing the automatic or manual triggering of the special effects.

20 Claims, 5 Drawing Sheets

THEMED INTERACTIVE ENVIRONMENT IN THE FORM OF A MOTEL OR HOTEL AND METHOD OF OPERATING THE SAME

CROSS REFERENCE

This application claims priority to U.S. patent application Ser. No. 15/716,443 filed Sep. 26, 2017 which claims priority to U.S. Patent Application No. 62/399,824 filed Sep. 26, 2016 both of which are incorporated for all purposes.

FIELD OF THE INVENTION

The embodiments of the present invention relate to a themed motel or hotel having interactive features.

BACKGROUND

Hotel and motel stays have not changed much over time. The hotel and motel experience does not tend to be overly memorable unless something goes awry. That is, hotel and motel stays have been focused on providing relaxing downtime between work, travel or vacation events.

It would be advantageous to develop more exciting and interactive hotels and motels which serve as amusement attractions and which may also operate as functioning hotels and motels.

SUMMARY

In one embodiment, a hotel or motel room incorporates special effects in accordance with a particular theme (e.g., haunted room). A control room provides a concealed area for personnel and/or automated systems to trigger the special effects which may include, but are limited to shaking, rattling, rumbling, pepper ghosts, water fixtures being activated, thunder and lightning, swapping tiles with digital graphics, turning on a TV, clock or light, etc. In one embodiment, heat sensors, weight sensors, floor mats, proximity sensors, and/or other sensors determine positions of guests in the hotel room thereby allowing the automatic or manual triggering of the special effects. For example, if a guest is brushing his or her teeth in a bathroom mirror a ghost may be triggered to appear in the mirror; if a guest is using toilet a sound effect may be triggered; if a guest is showering, colored water may be piped into the shower; if a guest is going to sleep, the bed may shake, or TV may turn on, etc.

In one embodiment, a plurality of sensors is positioned and configured to collect guest data including guest location throughout the property. The collected guest data is transmitted to a central system that manages the special effects or directly to the special effect. In either instance, the guest location triggers the special effect. In common areas outside of the hotel and motel rooms, cameras, communicatively linked to the central system, may be used to track guest location and cause the triggering of special effects. In some instances, facial recognition software is used with camera outputs to prevent a special effect from being triggered on the same guest more than once or other pre-established number of times.

Certain special effects may be automatically triggered based on time of day, day of the week, etc. Other special effects may be customized for the subject guests and based on the guests' likes and dislikes as collected via a guest registration process.

Other variations, embodiments and features of the present invention will become evident from the following detailed description, drawings and claims.

DETAILED DESCRIPTION

Figure 1:
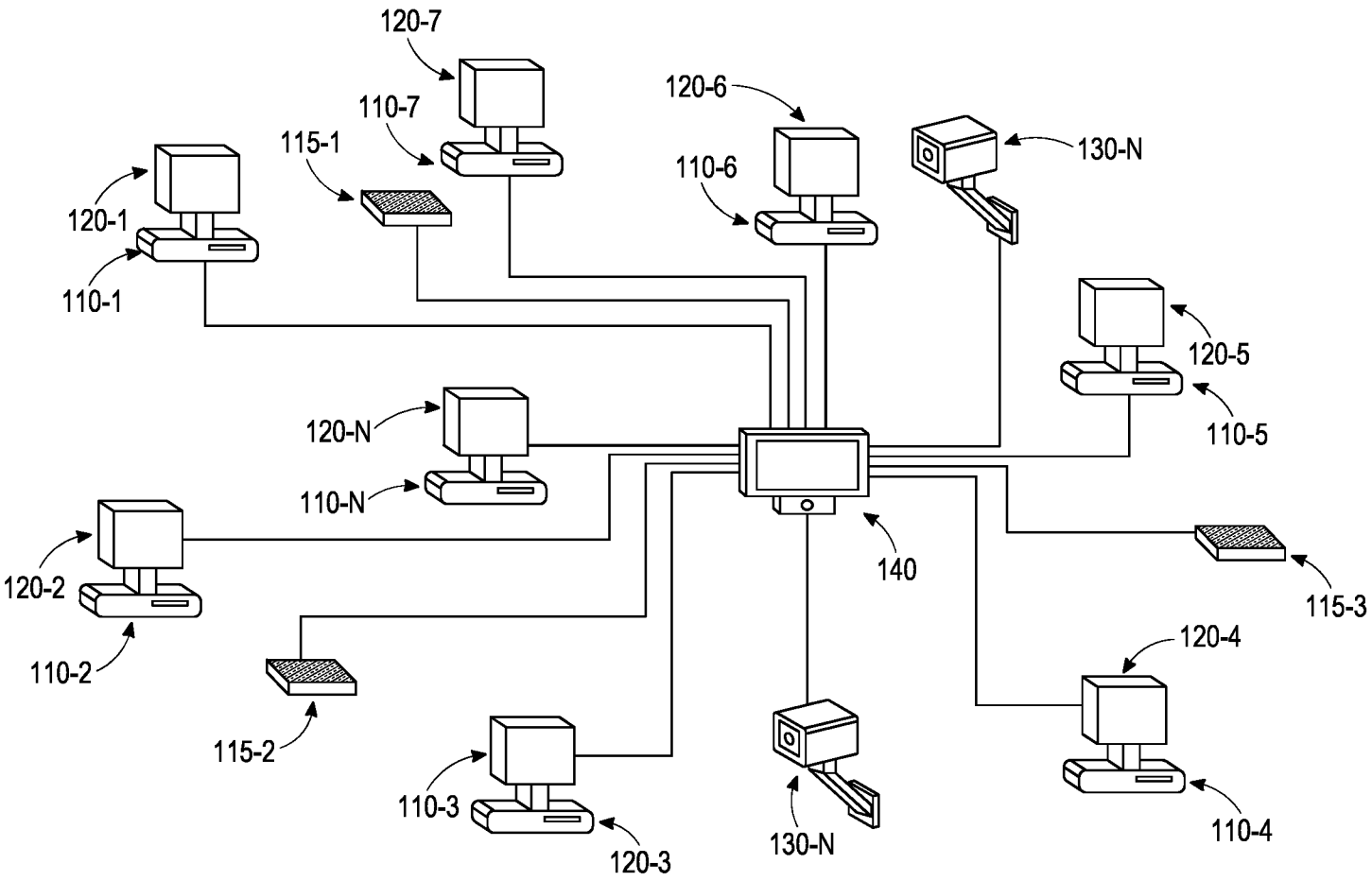
FIG. 1 illustrates a block diagram of system according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The embodiments of the present invention relate generally to an interactive hotel or motel. Hotel and motel are interchangeable for purposes of this document. Indeed, while a themed hotel is used herein to detail the embodiments of the present invention, any confined structure (e.g., barn, apartment complex, office building, boat, mall, etc.) is suitable for the embodiments of the present invention.

As shown in FIG. 1, an interactive system 100 according to the embodiments of the present invention utilizes a plurality of sensors 110-1 through 110-N, a plurality of special effects 120-1 through 120-N triggered by outputs of sensors 110-1 through 110-N, a plurality of special effects 115-1 through 115-N triggered unrelated to outputs of sensors 110-1 through 110-N, one or more cameras 130-1 through 130-N and a central controller 140. Although each special effect 120-1 through 120-N is shown with an associated sensor 110-1 through 110-N, it is apparent that the output of a single sensor may be responsible for triggering multiple special effects. The central controller 140 may be any computer having one or more processors configured to run software instructions.

Figure 2:
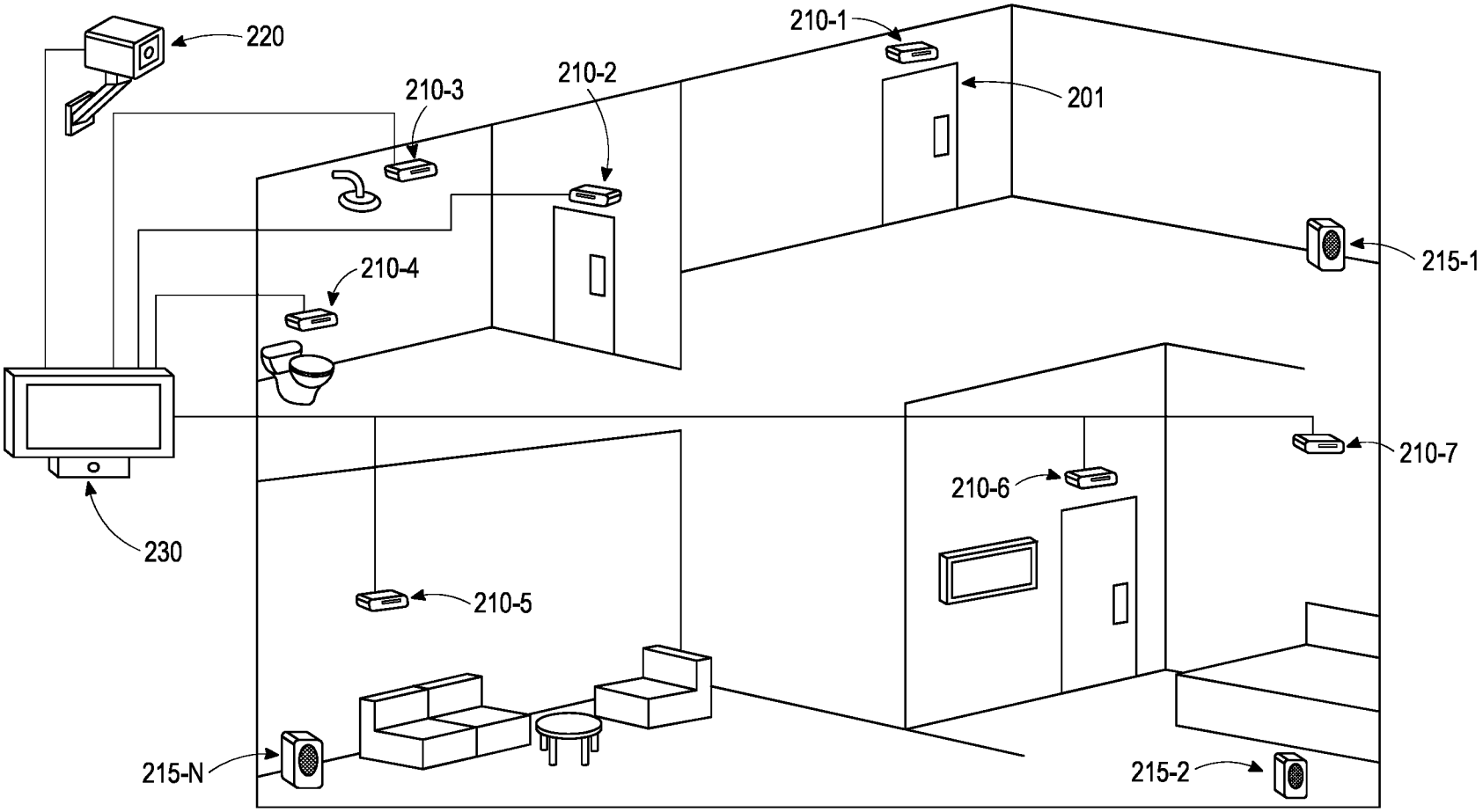
FIG. 2 illustrates an exemplary room layout and sensor positioning according to the embodiments of the present invention.

FIG. 2 shows an exemplary room layout 200 and a position of a plurality of sensors 210-1 through 210-7. The outputs of the sensors 210-1 through 210-7 trigger special effects proximate to the sensors 210-1 through 210-7. More particularly, sensor 210-1 is positioned to detect guests entering the room via door 201; sensor 210-2 is positioned to detect guests entering the bathroom; sensor 210-3 is positioned to detect guests using the toilet; sensor 210-4 is positioned to detect guests using the shower or bath; sensor 210-5 is positioned to detect guests seated or laying on the couch; sensor 210-6 is positioned to detect guests entering the bedroom; and sensor 210-7 is positioned to detect guests seated or laying in the bed. As detailed below, each of the sensors 210-1 through 210-7 may be used to trigger one or more special effects proximate to the position of the sensor 210-1 through 210-7. A video camera 220 provides guest location in a common hallway outside of the room. The sensors 210-1 through 210-7 and camera 220 are communicatively linked to a central controller 230. Speakers 215-1 through 215-N may be used to pump in sounds such as echoing footsteps, howls, screeches, etc.

The sensors 210-1 through 210-7 may be any type of sensor including optical sensors, laser sensors, thermal sensors, weight sensors, motion sensors, proximity sensors, IR and RF sensors and so on. Indeed, any sensor configured to detect the location and/or movement of guests may be used, including cameras (if not inside of a guest room).

Figure 3:
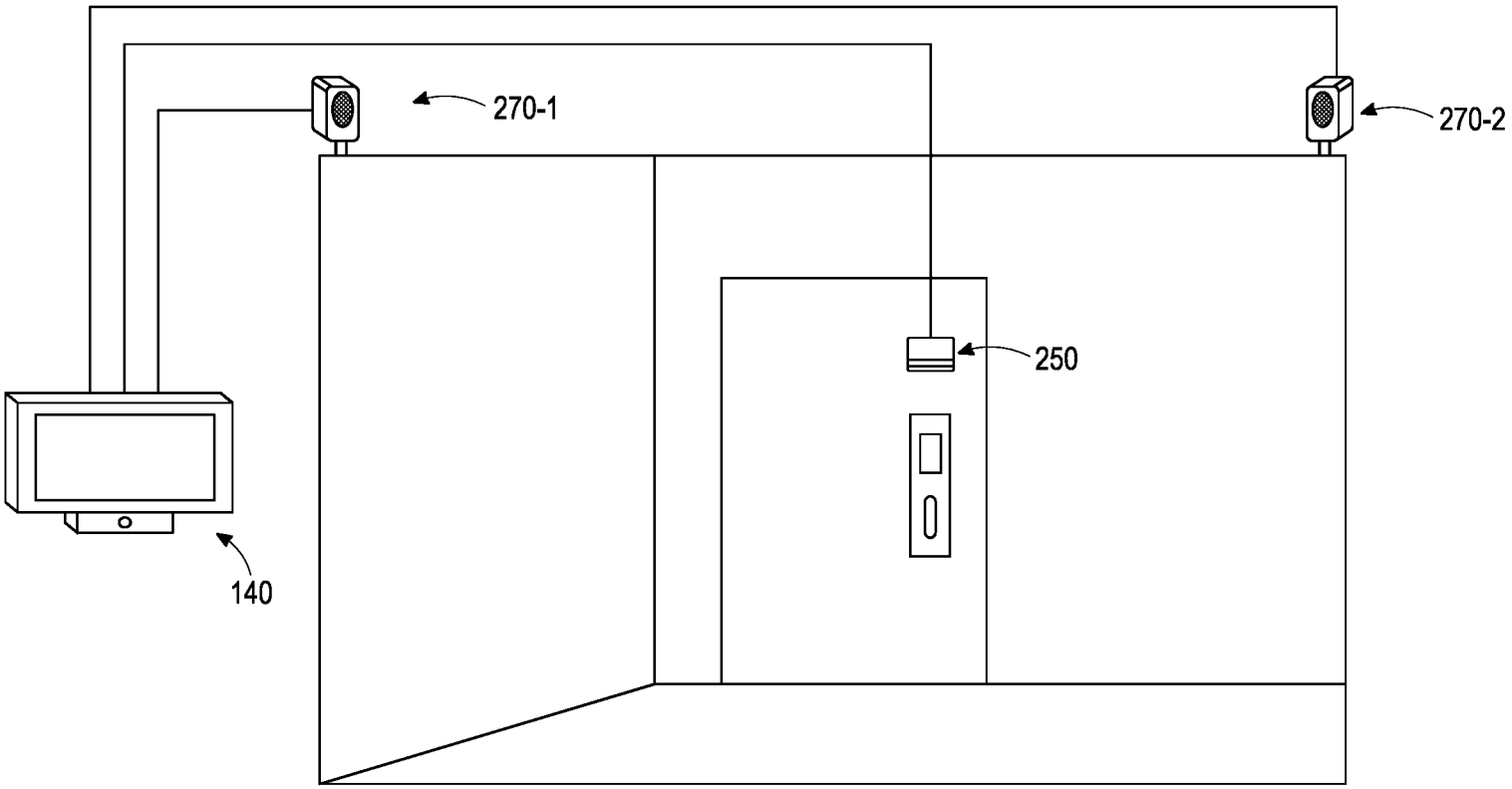
FIG. 3 illustrates use of a room key to determine guest location according to the embodiments of the present invention.

In another embodiment, as shown in FIG. 3, a digital or magnetic room key 250 is communicatively linked to the central controller 260. Use of the room key 250 to enter the room can be used to determine a specific guest location. The location of the room key 250 in the room can also be used to infer that the guest is in the room as guests tend to travel with the room key 250. The room key 250 may also be used to identify guests in the common areas. When issued the room keys 250 may be programmed with the name of the guest such that when the room key 250 communicates with the central controller 260 the name of the guest and/or facial shot of the guest, captured at check in, is transmitted along with the location. The cameras and facial recognition cameras may capture the location of guests in common areas (e.g., bars, nightclubs, restaurants, check-in area, grounds of the property, etc.) Common areas may also utilize one or more microphones 270-1, 270-2 to acquire guest conversations and create and trigger specific special effects responsive thereto. The outputs of the microphones 270-1, 270-2 are transmitted to the central controller 260.

While many special effects are electro-mechanically driven, in one embodiment, hotel personnel also participate in the interactive environment. With a haunted theme, hotel personnel may stumble around the hotel like zombies and target specific guests desiring a realistic experience. The hotel may include hidden rooms and dedicated personnel areas to provide means for hiding personnel as needed. A central control room may be used to house the central controller which receives sensor outputs and monitor video camera outputs so that personnel may undertake steps to manually trigger special effects or create special effects based on acquired real-time guest location data.

Figure 4:
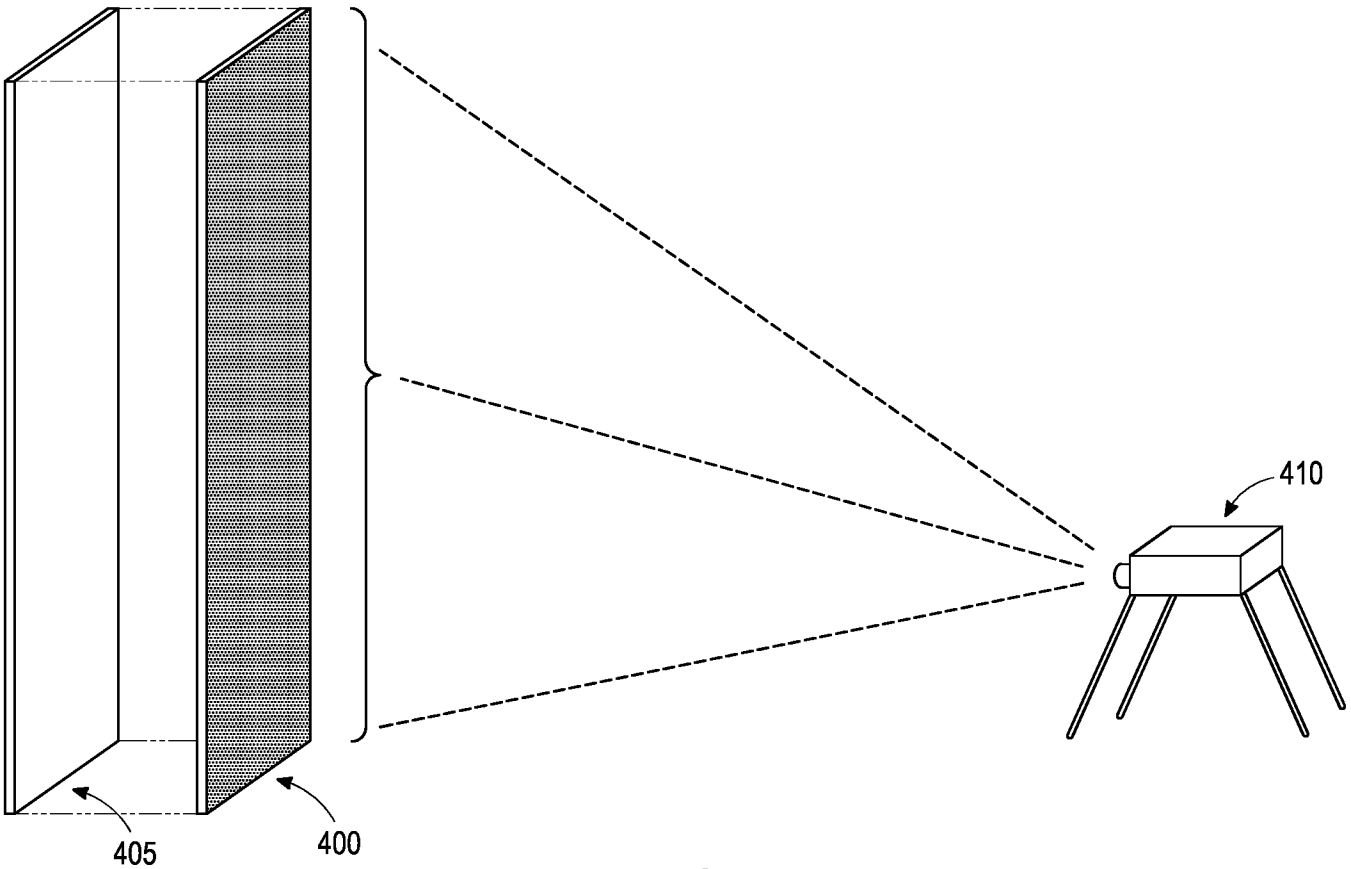
FIG. 4 illustrates a projection system according to the embodiments of the present invention.

In one embodiment, as shown in FIG. 4, the elevation 400 of the motel 405 may be modified using backlit features or projection means 410. In one embodiment, the motel may be changed from a conventional looking motel to a rundown property. For example, during the day the motel looks appealing while during the evening the motel is made to show signs of aging or a fire or explosion ruined it or the like. The transformation of the motel may be the centerpiece of a daily show whereby guests may congregate about the front of the motel to watch the transformation. The daily show may include other special effects utilizing pixel lighting, fiber optic lighting, projections, fire, and other effects. In one embodiment, the transformation of the motel coincides with two magic wands positioned outside of the motel coming together.

TABLE 1

Table 1 lists exemplary special effects of the type, which may be present in the motel or hotel room.

| Special Effect | Action |
|---|---|
| Door knockers inside walls, doors, and./or ceiling | Noises inside walls, doors and/or ceiling |
| Speaker systems hidden within furniture, walls, doors, or props | Whispers, knocks, talking, and other sounds |
| Shaking Bed | Bed shakes |
| Ringing Phone Prop | Phone rings |
| Mist Sprayers | Broken pipe from wall simulation; side spraying shower effect; and sound of another guest sneezing and spray mist on guest |
| Scrim/Screen on walls or ceiling | Project or display content |
| Box Window | Generate thunder and lightning; themed landscape, etc. |
| Automatic Opening and Closing Features | Actuators, pulleys, and or other robotic devices drive the opening and closings of drawers, closets, doors, etc. (sensors can prevent injury to guests) |
| Walking Feet Effect | Sounds of footsteps |
| Illusions | Project content against a wall, ceiling or mirror |
| Videos | Turn on/off pre-recorded snippets of video |
| Adjoining Room Door (Door Separating Adjoining Rooms) or Other Doors | Door may open randomly at which point guest may close it (the door may open again), guest may go into other room and explore where other special effects may be triggered; may also be used to award the guest with a suite or larger room. |
| Colored Bath/Shower | Upon activation of the bath/shower and detection of guest close to bath/shower, dye or other color agents or a bath bomb may be added to the water to change its color |
| Screen or Window in Pool | Content displayed on screen or window at bottom of the pool when a guest is swimming |

Besides those special effects listed in Table 1, there are many features, including but not limited to trap doors, slides, mazes, motion elevators, angled walkways, pepper ghosts, simulated thunder and lightning, that may be used in rooms, hallways, common areas of the motel or on the grounds thereof. The hotel room windows may also look out to a secondary controlled and confined area outside of the room but within a structure that cannot be seen from the front of the hotel. In this controlled area, the lightning and thunder (and other special effects) can be viewed from inside the room.

Additional special effects that may be implemented about the motel property include shaking, rumbling, electrical loss, malfunction simulation, etc. With the malfunction simulation, guests may be taken to a designated area to explore while the fake malfunction is supposedly being addressed. This may happen on the elevator or other areas around the property.

In one embodiment, video or static cameras proximate to check-in are configured to capture facial images of guests which can be subjected to biometric analysis for later use including identification of guests within the motel or on the grounds such that the same special effect is not triggered twice for the same guest. As set forth above, the room keys 250 may also serve this purpose.

Figure 5:
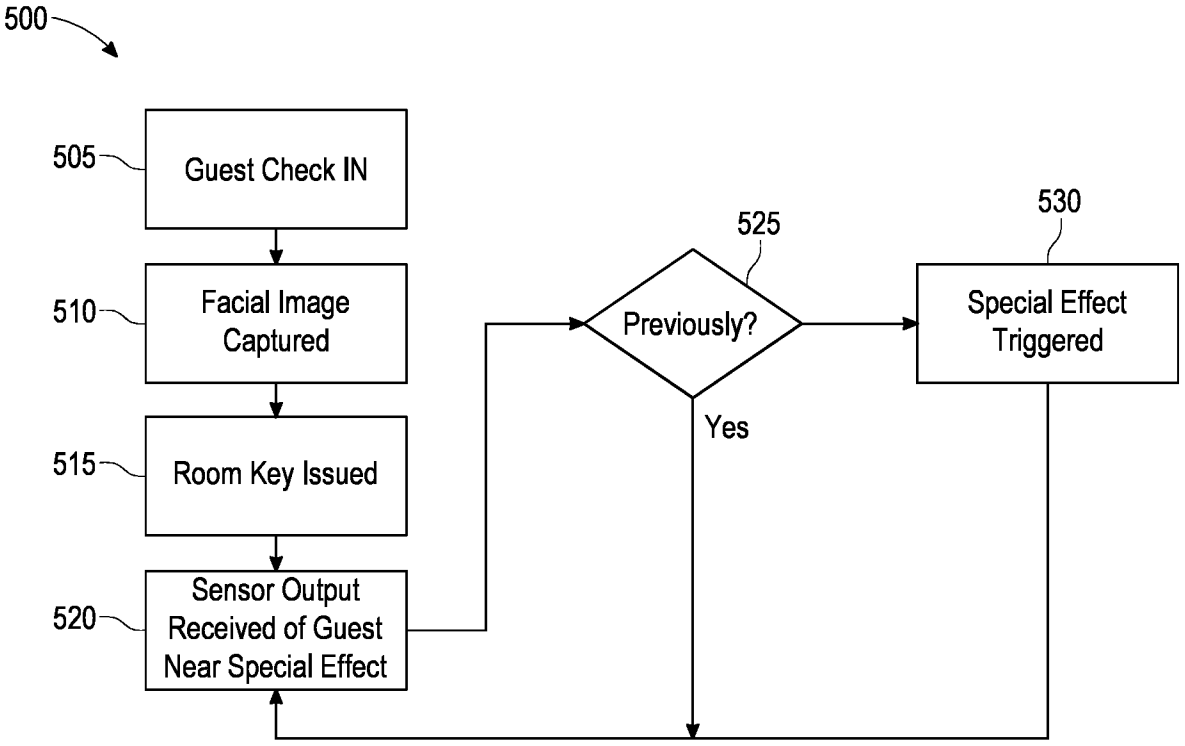
FIG. 5 illustrates a flow chart detailing one method of operating an interactive hotel or motel according to the embodiments of the present invention.

Now referring to FIG. 5, a flow chart 500 details one methodology of operating a motel according to the embodiments of the present invention. At 505, guests check in to the property. At check in guests may provide the property with their desired level of interaction and level of scare desired. The information may then be associated with the guest via the facial recognition, room keys and/or smart devices. At 510, facial data of the guests may be captured. At 515, guests are issued room keys with tracking capabilities. In one embodiment, when the room keys are used they transmit a signal to the central controller. Alternatively, the room keys may have GPS technology embedded therein. In another embodiment, guests may allow the property to track guest location using the guests' smart device. At 520, the central controller receives a sensor output indicating that a guest is in proximity to a subject special effect. At 525, it is determined, via facial recognition, room key or other technique, whether the guest has experienced that subject special effect previously. The central controller may alternatively determine when the special effect was last triggered and elect to trigger the special effect the next time a sensor detects a guest nearby. If so, the guest has experienced the special effect previously, the special effect is not triggered. If the guest has not experienced the subject special effect previously, at 530, the special effect is triggered by the central controller. The central controller may trigger the special effect directly or via the sensor that detected the guest location.

In another embodiment, sensors are dispersed about a hotel/motel room and about the property to collect guest movement and activity data which may be used by the property for purposes of tailoring experiences for guests. In such an embodiment, triggering the special effects is not the objective but rather collecting data associated with the guests for marketing purposes is the objective.

Although the invention has been described in detail with reference to several embodiments, additional variations and modifications exist within the scope and spirit of the invention as described and defined in the following claims.

I claim:

1. An attraction comprising:

a room;

a central controller in communication with one or more sensors positioned to detect locations of one or more people in said room and one or more special effects in said room, wherein said one or more special effects in said room are configured to be triggered responsive to people being detected by said one or more sensors at one or more pre-established locations within said room; and wherein said one or more special effects are selectively triggered by said central controller only if it is determined by said central controller and/or one or more sensors that (i) a person has not previously experienced said one or more special effects based on a feature or item unique to a person or (ii) a person has experienced said one or more special effects previously based on a feature or item unique to a person and a pre-established amount of time has passed since a person last experienced said one or more special effects.

2. The attraction of claim 1 wherein said sensors include heat sensors, location sensors, proximity sensors, infrared sensors and/or weight sensors.

3. The attraction of claim 1 wherein said special effects include one or more of the following actions:

shaking; rattling; rumbling; water fixtures being activated; changing water color; turning on and off appliances and electronic devices; activating digital graphics, projecting video or static content and transmitting sounds.

4. The attraction of claim 1 wherein said special effects are selected from displaying a ghost in a mirror, shaking a bed, turning on or off a TV, transmitting sounds, piping in colored shower, sink and/or bath water.

5. The attraction of claim 1 further comprising use sensors integrated into tangible articles utilized by patrons of said amusement area, said use sensors configured to activate special effects.

6. The attraction of claim 5 wherein said tangible articles are selected from an air conditioning unit, wall control unit, deadbolt, key card and mat.

7. A method comprising:

utilizing a central controller in communication with one or more sensors and special effects;

positioning one or more sensors in a room, said one or more sensors configured to determine a location of one or more people in said room;

positioning one or more special effects in said room;

via said central controller receiving outputs of said one or more sensors determining if a person in said room has experienced said one or more special effects based on a feature or item unique to a person or a last time a person experienced said one or more special effects; and responsive to said central controller and/or one or more sensors determining (i) a person in said room not having experienced the one or more special effects previously or (ii) a person has experienced said one or more special effects previously and a pre-established amount of time has passed since a person last experienced said one or more special effects, triggering at least one of said one or more special effects.

8. The method of claim 7 further comprising utilizing one or more heat sensors, location sensors proximity sensors, infrared sensors and/or weight sensors.

9. The method of claim 7 further comprising utilizing special effects including one or more of the following actions:

shaking; rattling; rumbling; water fixtures being activated; changing water color; turning on and off appliances and electronic devices; activating digital graphics, projecting video or static content and transmitting sounds.

10. The method of claim 9 further comprising utilizing special effects selected from displaying a ghost in a mirror or a Pepper's ghost, shaking a bed, turning on or off a TV, projecting lightning, transmitting sounds of thunder and piping in colored shower, sink and/or bath water.

11. The method of claim 9 further comprising integrating use sensors into tangible articles utilized by patrons of said room.

12. The method of claim 11 further comprising integrating use sensors into tangible articles including an air conditioning unit, wall control unit, deadbolt, key card and/or mat.

13. The method of claim 12 further comprising activating special effects responsive to use of said tangible articles.

14. The method of claim 7 further comprising responsive to said one or more sensors detecting at least one of said one or more people in said room, triggering a special effect of simulating lightning and thunder.

15. A system comprising:

a central controller;

a defined attraction area having one or more biometric sensors, one or more location sensors and one or more special effects, each in communication with said central controller, said one or more biometric sensors positioned and configured to detect the identity of persons entering said defined attraction area and said one or more location sensors positioned and configured to determine the location of identified persons entering said defined attraction area; and wherein upon confirming an identify of a person entering said defined attraction area and determining, via said central controller and/or one or more sensors, that said identified person (i) has not previously experienced said one or more special effects or (ii) a person has experienced said one or more special effects previously and a pre-established amount of time has passed since a person last experienced said one or more special effects, said central controller configured to trigger said one or more of said special effects within said defined attraction area.

16. The system of claim 15 wherein said one or more location sensors include heat sensors, location sensors, proximity sensors, infrared sensors and/or weight sensors.

17. The system of claim 15 wherein said special effects include one or more of the following actions:

shaking; rattling; rumbling; water fixtures being activated; changing water color; turning on and off appliances and electronic devices; activating digital graphics, projecting video or static content and transmitting sounds.

18. The system of claim 15 wherein said special effects are selected from displaying a ghost in a mirror, shaking a bed, turning on or off a TV, transmitting sounds, piping in colored shower, sink and/or bath water.

19. The system of claim 15 further comprising use sensors integrated into tangible articles utilized by patrons of said amusement area, said use sensors configured to activate special effects.

20. The system of claim 15 wherein said one or more biometric sensors include passive facial recognition detectors and iris scanners.

* * * * *